US006659422B2

(12) United States Patent
Padroni

(10) Patent No.: US 6,659,422 B2
(45) Date of Patent: Dec. 9, 2003

(54) CONTROL METHOD FOR AN ELECTROMAGNETIC ACTUATOR FOR THE CONTROL OF A VALVE OF AN ENGINE FROM A REST CONDITION

(75) Inventor: Gianni Padroni, Portoferraio (IT)

(73) Assignee: Magnetti Marelli Powerstrain S.p.A., Turin (IT)

( * ) Notice: Subject to any disclaimer, the term of this patent is extended or adjusted under 35 U.S.C. 154(b) by 0 days.

(21) Appl. No.: 10/174,326

(22) Filed: Jun. 18, 2002

(65) Prior Publication Data

US 2003/0034470 A1 Feb. 20, 2003

(30) Foreign Application Priority Data

Jun. 19, 2001 (IT) ..... BO2001A0389

(51) Int. Cl.[7] ..... F01L 9/04
(52) U.S. Cl. ..... 251/129.04; 123/90.11
(58) Field of Search ..... 251/129.01–129.22; 123/90.11

(56) References Cited

U.S. PATENT DOCUMENTS

| | | | | |
|---|---|---|---|---|
| 4,544,986 A | | 10/1985 | Buchl | 361/152 |
| 4,614,170 A | | 9/1986 | Pischinger et al. | 123/90.11 |
| 5,905,625 A | | 5/1999 | Schebitz | 361/154 |
| 6,141,201 A | | 10/2000 | Schmitz | 361/154 |
| 6,257,182 B1 | * | 7/2001 | Hara et al. | 251/129.16 |
| 6,374,783 B1 | * | 4/2002 | Toriumi | 251/129.16 |
| 6,390,036 B1 | * | 5/2002 | Yuuki | 251/129.16 |
| 6,390,039 B2 | * | 5/2002 | Fuwa | 251/129.1 |
| 6,390,113 B1 | | 5/2002 | Reif | 137/1 |

FOREIGN PATENT DOCUMENTS

| | | |
|---|---|---|
| DE | 19544207 | 6/1997 |
| EP | 1099828 | 5/2002 |

OTHER PUBLICATIONS

U.S. patent application Ser. No. 10/174,323, entitled "Control Method for an Electromagnetic Actuator for the Control of a Valve of an Engine from an Abutment Condition" filed Jun. 18, 2002.

* cited by examiner

*Primary Examiner*—Paul J. Hirsch
(74) *Attorney, Agent, or Firm*—Baker & Daniels

(57) ABSTRACT

A control method for an electromagnetic actuator for the control of a valve of an engine from a rest condition, in which an actuator body actuating the valve is held by at least one elastic body in an intermediate position between two de-excited electromagnets; in order to bring the actuator body into a position of abutment against a first electromagnet, the two electromagnets are alternately excited in order to generate a progressively amplified oscillating movement of the actuator body about the intermediate position, the excitation parameters of each electromagnet being calculated as a function of the difference between the elastic energy statically stored by the elastic body in the abutment position and the mechanical energy dynamically stored in the mechanical system formed by the actuator body and the elastic body.

10 Claims, 2 Drawing Sheets

Fig.1
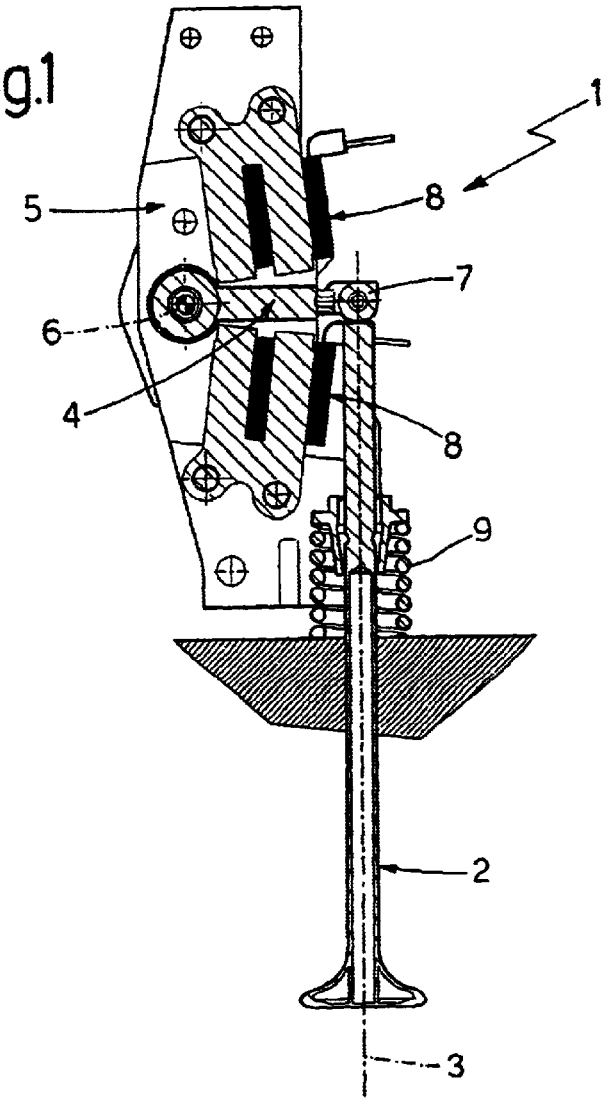
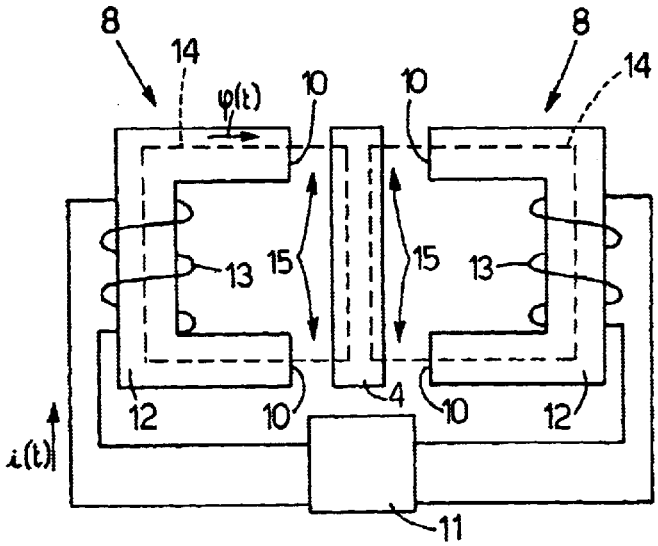
Fig.2

CONTROL METHOD FOR AN ELECTROMAGNETIC ACTUATOR FOR THE CONTROL OF A VALVE OF AN ENGINE FROM A REST CONDITION

The present invention relates to a control method for an electromagnetic actuator for the control of a valve of an engine.

BACKGROUND OF THE INVENTION

As is known, internal combustion engines of the type disclosed in Italian Patent Application B099A000443 filed on Aug. 4, 1999, are currently being tested, in which the intake and exhaust valves are moved by electromagnetic actuators. These electromagnetic actuators have undoubted advantages, as they make it possible to control each valve according to a law optimised for any operating condition of the engine, while conventional mechanical actuators (typically camshafts) make it necessary to define a lift profile for the valves which represents an acceptable compromise for all the possible operating conditions of the engine.

An electromagnetic actuator for a valve of an internal combustion engine of the type described above normally comprises an actuator body, which is connected to the stem of the valve and, in rest conditions, is held by at least one spring in an intermediate position between two de-excited electromagnets; in operation, the electromagnets are controlled so as alternately to exert a force of attraction of magnetic origin on the actuator body in order to displace this actuator body between the two limit abutment positions, which correspond to a position of maximum opening and a position of closure of the respective valve.

When the engine is off, the electromagnets are de-excited, and the actuator body is in the above-mentioned intermediate position under the action of the elastic force exerted by the spring; when the ignition of the engine is requested, the actuator body must initially be brought into a limit abutment position against an electromagnet corresponding to the closed position of the respective valve. However, neither of the two electromagnets is able to exert a force sufficient to displace the stationary actuator body, i.e. lacking kinetic energy, from the intermediate position to the abutment position; for this reason, the electromagnets are actuated alternately in order to generate an oscillating movement of the actuator body about the intermediate rest position, which oscillating movement is progressively amplified in order to cause the actuator body to come into abutment against the desired electromagnet.

In known electromagnetic actuators, the control of the electromagnets in order to bring the actuator body from the intermediate rest position to the desired abutment position takes place as an open loop, by supplying the electromagnets with respective current waves whose duration and intensity are predetermined during the actuator design stage. It has been observed, however, that the open loop control during the above-mentioned stage of actuation of the electromagnetic actuator has various drawbacks, due chiefly to the dispersion and the drift over time of the characteristics of the actuator, and the variation of the characteristics of the actuator with temperature variations. It has in particular been observed that the open loop control during the stage of actuation of the electromagnetic actuator leads in some conditions to a failure to achieve the desired condition of abutment (or to the achievement of this condition of abutment in very long periods of time) and leads, in other conditions, to the achievement of the desired abutment condition with a speed of impact of the actuator body against the electromagnet which is relatively very high, with a resultant increase both in the mechanical stresses on the electromagnetic actuator and in the noise generated by this electromagnetic actuator.

In order to attempt to remedy the above-described drawbacks, it has been proposed to use an external position sensor, which provides, instant by instant, the exact position of the actuator body and makes it possible precisely to control the actual position of the actuator body; position sensors able to provide the precision and service life needed for profitable use for this purpose are not, however, commercially available.

SUMMARY OF THE INVENTION

The object of the present invention is to provide a control method for an electromagnetic actuator for the control of a valve of an engine, which is free from the above-mentioned drawbacks and, in particular, is easy and economic to embody.

The present invention therefore relates to a control method for an electromagnetic actuator for the control of a valve of an engine as claimed in claim 1.

BRIEF DESCRIPTION OF THE DRAWINGS

The present invention will be described below with reference to the accompanying drawings, which show a non-limiting embodiment thereof, in which:

FIG. 1 is a diagrammatic view, in lateral elevation and partial cross-section, of a valve of an engine and a relative electromagnetic actuator operating according to the method of the present invention;

FIG. 2 is a diagram of an electromagnetic circuit of the actuator of FIG. 1;

DETAILED DESCRIPTION OF THE INVENTION

Figure 3:
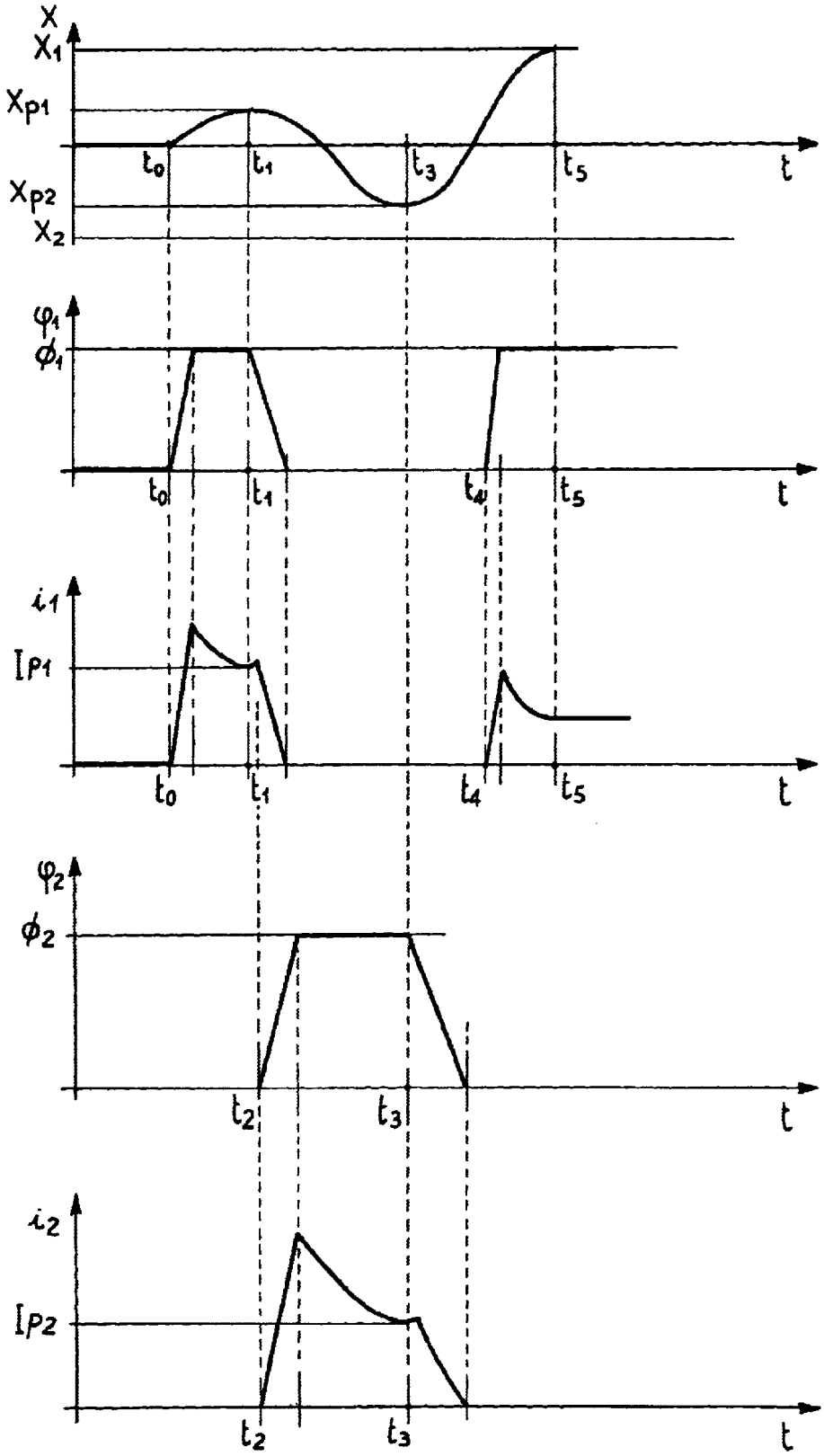
FIG. 3 shows graphs of the time curve of some magnitudes characteristic of the electromagnetic actuator of FIG. 1.

In FIG. 1, an electromagnetic actuator (of the type disclosed in European Patent Application EP10871 10) is shown overall by 1 and is coupled to an intake or exhaust valve 2 of an internal combustion engine of known type in order to displace this valve 2 along a longitudinal axis 3 of the valve between a closed position (known and not shown) and a position of maximum opening (known and not shown).

The electromagnetic actuator 1 comprises an oscillating arm 4 made at least partly from ferromagnetic material, which has a first end hinged on a support 5 so as to be able to oscillate about an axis of rotation 6 transverse to the longitudinal axis 3 of the valve 2, and a second end connected by a hinge 7 to an upper end of the valve 2. The electromagnetic actuator 1 further comprises two electromagnets 8 borne in a fixed position by the support 5 so that they are disposed on opposite sides of the oscillating arm 4, and a spring 9 coupled to the valve 2 and adapted to maintain the oscillating arm 4 in an intermediate position (shown in FIG. 1) in which this oscillating arm 4 is equidistant from the polar expansions 10 of the two electromagnets 8. According to a different embodiment which is not shown, the spring 9 coupled to the valve 2 is flanked by a torsion bar spring coupled to the hinge disposed between the support 5 and the oscillating arm 4.

In operation, a control unit 11 controls the position of the oscillating arm 4, i.e. the position of the valve 2, in feedback and in a substantially known manner, on the basis of the engine operating conditions; the control unit 11 in particular excites the electromagnets 8 in order alternately or simultaneously to exert a force of attraction of magnetic origin on the oscillating arm 4 in order to cause it to rotate about the axis of rotation 6 thereby displacing the valve 2 along the respective longitudinal axis 3 and between the above-mentioned positions of maximum opening and closure (not shown).

As shown in FIG. 1, the valve 2 is in the above-mentioned closed position (not shown) when the oscillating arm 4 is in abutment on the excited upper electromagnet 8, is in the above-mentioned position of maximum opening (not shown) when the oscillating arm 4 is in abutment on the excited lower electromagnet 8, and is in a partially open position when both electromagnets are de-excited and the oscillating arm 4 is in the above-mentioned intermediate position (shown in FIG. 1) as a result of the force exerted by the spring 9.

As shown in FIG. 2, each electromagnet 8 comprises a respective magnetic core 12 coupled to a corresponding coil 13, which is supplied by the control unit 11 with a current i(t) that is variable over time in order to generate a flux (p(t) via a respective magnetic circuit 14 coupled to the coil 13. Each magnetic circuit 14 is in particular formed by the relative core 12 of ferromagnetic material, the oscillating arm 4 of ferromagnetic material and the air gap 15 between the relative core 12 and the oscillating arm 4.

Each magnetic circuit 14 has an overall reluctance R defined by the sum of the reluctance of the iron $R_{fe}$ and the reluctance of the air gap $R_0$ (equation [2]); the value of the flux $\phi(t)$ circulating in the magnetic circuit 14 is linked to the value of the current i(t) circulating in the relative coil 13 by equation [1], in which N is the number of turns of the coil 13:

$$N*i(t)=R*\phi(t) \quad [1]$$

$$R=R_{fe}+R_0 \quad [2]$$

In general, the value of the overall reluctance R depends both on the position x(t) of the oscillating arm 4 (i.e. on the amplitude of the air gap 15, which is equal, less a constant, to the position x(t) of the oscillating arm 4), and on the value assumed by the flux $\phi(t)$. Leaving aside negligible errors, i.e. as a first approximation, it can be considered that the reluctance value of the iron $R_{fe}$ depends only on the value assumed by the flux $\phi(t)$, while the value of the reluctance of the air gap $R_0$ depends only on the position x(t), i.e.:

$$R(x(t), \phi(t))=R_{fe}(\phi(t))+R_0(x(t)) \quad [3]$$

$$N*i(t)=R(x(t), \phi(t))*\phi(t) \quad [4]$$

$$N*i(t)=R_{fe}(\phi(t))*\phi(t)+R_0(x(t))*\phi(t) \quad [5]$$

$$N*i(t)=H_{fe}(\phi(t))+R_0(x(t))*\phi(t) \quad [6]$$

$$R_0(x(t))=(N*i(t)-H_{fe}(\phi(t)))/\phi(t) \quad [7]$$

It is then clear from equation [7] that it is possible to calculate the value assumed by the reluctance of the air gap $R_0$, and therefore the position x(t) of the oscillating arm 4, when the value assumed by the flux $\phi(t)$ and the value assumed by the current i(t) are known; in particular, once the value assumed by the reluctance of the air gap $R_0$ has been calculated, it is relatively simple to obtain the position x(t) of the oscillating arm 4 as the structural properties of the magnetic circuits 14 are known.

The relationship between the air gap reluctance $R_0$ and the position x can be obtained relatively simply by analysing the characteristics of the magnetic circuit 14 (an example of a behavioural model of the air gap 15 is shown by equation [9] below). Once the relationship between the air gap reluctance $R_0$ and the position x is known, the position x can be obtained from the air gap reluctance $R_0$ by applying the inverse relationship (applicable using either the exact equation, or by using an approximate method of digital calculation). The following equations summarise the above:

$$R_o(x(t)) = \frac{N \cdot i(t) - H_{fe}(\varphi(t))}{\varphi(t)} \quad [8]$$

$$R_0(x(t))=K_1[1-e^{-k_2 \cdot x(t)}+k_3 \cdot x(t)]+K_0 \quad [9]$$

$$x(t) = R_0^{-1}(R_o(x(t))) = R_0^{-1}\left(\frac{N \cdot i(t) - H_{fe}(\varphi(t))}{\varphi(t)}\right) \quad [10]$$

The constants $K_0$, $K_1$, $K_2$, $K_3$ are constants that can be obtained experimentally by means of a series of measurements of the magnetic circuit 14.

It will be appreciated from the above that the position x(t) of the oscillating arm 4 may be precisely calculated only when the value assumed by the flux $\phi(t)$ is significantly non-zero, i.e. when at least one of the electromagnets 8 is excited; when both the electromagnets 8 are de-excited, it is not possible to calculate the position x(t) of the oscillating arm 4.

As shown in FIG. 3, in a rest position in which both electromagnets 8 are de-excited, the oscillating arm 4 is immobile in the above-mentioned rest position, which conventionally corresponds to a zero value of the position x(t) of the oscillating arm 4. Before the engine can be started, it is necessary to bring the valve 2 into the above-mentioned closed position (not shown), which corresponds to the condition of abutment of the oscillating arm 4 against the upper electromagnet 8 and corresponds to a value $X_1$ of the position x(t) of this oscillating arm 4 (while the value $X_2$ of the position x(t) of the oscillating arm 4 corresponds to the condition of abutment of the oscillating arm 4 against the lower electromagnet 8).

In order to bring the oscillating arm 4 into abutment against the upper electromagnet 8, it is necessary alternately to excite the two electromagnets 8 in order to generate a progressively amplified oscillating movement of the oscillating arm 4 about the intermediate position, since neither electromagnet is able to exert a magnetic force sufficient to displace the stationary oscillating arm, i.e. lacking kinetic energy, from the intermediate position to the position of abutment against the action of the spring 9.

At the time instant to, the upper electromagnet 8 is excited with a respective current $i_1(t)$, which is controlled in a known manner in order to bring, after a brief initial transient, the upper electromagnet 8 to work with a constant flux value $\phi_1(t)$ equal to a normal operating value $\Phi_1$. As a result of the force of magnetic attraction generated by the upper electromagnet 8, the oscillating arm 4 is displaced towards the upper electromagnet 8 and the position x(t) of the oscillating arm tends to increase until reaching a relative maximum point $X_{p1}$, in which the elastic force generated by the spring 9 is higher than the magnetic force generated by the upper electromagnet 8 and causes an inversion of the movement of the oscillating arm 4.

Starting from the analysis of equation [6], it will be appreciated that the intensity of the current $i_1(t)$ increases progressively during the transient in order to cause the flux $\phi_1(t)$ rapidly to reach the normal operating value $\Phi_1$ (it is evident that as a result of the presence of very high inductances the value of the current $i_1(t)$ always varies in a relatively slow manner); subsequently, as the value of the flux $\phi_1(t)$ is kept constant, the intensity of the current $i_1(t)$ depends on the value of the reluctance of the air gap $R_0$, which decreases as the value of the position x(t) increases (i.e. as the oscillating arm 4 approaches the upper electromagnet 8). Therefore, once the transient period has ended, the intensity of the current $i_1(t)$ progressively decreases until it reaches a relative minimum point $I_{p1}$ at the time instant $t_1$, at which the oscillating arm 4 reaches it its relative maximum point $X_{p1}$.

At the time instant $t_1$, the upper electromagnet 8 is de-excited, rapidly bringing the intensity of the current $i_1(t)$ to zero, and at a time instant $t_2$ the lower electromagnet 8 is excited with a respective current $i_2(t)$, which is controlled in a known manner in order to cause, after a brief initial transient, the lower electromagnet 8 to work with a constant flux value $\phi_2(t)$ equal to a normal operating value $\Phi_2$ (normally equal to the operating value $\Phi_1$). As a result of the force of magnetic attraction generated by the lower electromagnet 8 and as a result of the elastic energy previously stored in the spring 9, the oscillating arm 4 is displaced towards the lower electromagnet 8 and the position x(t) of the oscillating arm 4 tends to decrease until it reaches a relative minimum point $X_{p2}$ in which the elastic force generated by the spring 9 is higher than the magnetic force generated by the lower electromagnet 8 and causes an inversion of the movement of the oscillating arm 4 (as a result of the elastic energy stored in the spring 9, the minimum point $X_{p2}$ is, in absolute terms, greater than the minimum point $X_{p1}$).

When, at the time instant $t_1$, the control unit 11 detects the relative minimum point $I_{p1}$ of the current $i_1(t)$, the control unit 11 estimates the corresponding value $X_{p1}$ of the position x(t) of the oscillating arm 4 by applying equation [10], as both the value $\Phi_1$ assumed by the flux $\phi$1(t) and the value $I_{p1}$ assumed by the current $i_1(t)$ are known at the time instant $t_1$.

Once the value $X_{p1}$ of the position x(t) of the oscillating arm 4 is known, at the time instant $t_1$, the control unit 11 calculates the value of the mechanical energy $E_M(t)$ dynamically stored in the mechanical system SM composed of the oscillating arm 4 and the spring 9. In general, the mechanical energy $E_M(t)$ is given by the sum of the elastic energy $E_E(t)$ stored by the spring 9 and by the kinetic energy $E_K(t)$ possessed by the oscillating arm 4; however, at the time instant $t_1$, the oscillating arm 4 is substantially stationary and, therefore, lacks kinetic energy $E_K(t)$ and, at the time instant $t_1$, the mechanical energy $E_M(t)$ is equal to the elastic energy $E_E(t)$ stored by the spring 9 that can be readily and precisely obtained by applying equation [12]:

$$E_M(t) = E_E(t) + E_K(t) = \frac{1}{2}\cdot k\cdot(x^2(t) - X_0^2) + \frac{1}{2}\cdot m\cdot s^2(t) \quad [11]$$

$$E_M(t_1) = E_E(t_1) = \frac{1}{2}\cdot k\cdot(X_{p1}^2(t) - X_0^2) \quad [12]$$

$$E_{EX1} = \frac{1}{2}\cdot k\cdot(X_1^2(t) - X_0^2) \quad [13]$$

in which:

m is the mass of the oscillating arm 4;

s(t) is the speed of the oscillating arm 4;

k is the elastic constant of the spring 9;

$X_0$ is the position of the oscillating arm 4 corresponding to the rest position of the spring 9 (in the convention defined above, $X_0$=0).

Subsequently, the control unit 11 applies equation [13] in order to calculate the elastic energy $E_{EX1}$ statically stored by the spring 9 in the above-mentioned position of abutment against the upper electromagnet 8, i.e. in the position to which it is desired to bring and maintain the oscillating arm 4; on the basis of the difference between the elastic energy $E_{EX1}$ statically stored by the spring 9 in the desired abutment position and the mechanical energy $E_M(t)$ dynamically stored in the mechanical system SM at the time instant $t_1$, i.e. on the basis of the energy that still has to be supplied to the mechanical system SM in order to bring the oscillating arm 4 into the desired abutment position, the control unit 11 determines the excitation parameters of the lower electromagnet 8, i.e. it determines the value of the intensity, the value of the duration and the instant of commencement of the excitation current $i_2(t)$ that is supplied to the lower electromagnet 8.

Obviously, the excitation parameters of the lower electromagnet 8 are determined in order to provide the oscillating arm 4 in the shortest possible time with the mechanical energy that it lacks in order to reach the desired abutment position, taking account of the dissipation phenomena involved.

In the particular embodiment shown in FIG. 3, at the time instant $t_1$ (detected by the control unit 11 by researching the relative minimum point $I_{p1}$ of the current $i_1(t)$), the upper electromagnet 8 is de-excited, rapidly bringing the intensity of the current $i_1(t)$ to zero and, at a time instant $t_2$, immediately following the time instant $t_1$, the electromagnet 8 is excited with a respective current $i_2(t)$, which is controlled in a known manner in order to cause, after a brief initial transient, the lower electromagnet 8 to work with a constant flux value $\phi_2(t)$ equal to a normal operating value $\Phi_2$ (normally equal in absolute terms to the operating value $\Phi_1$). As a result of the force of magnetic attraction generated by the lower electromagnet 8 and under the effect of the elastic energy previously stored in the spring 9, the oscillating arm 4 is displaced towards the lower electromagnet 8 and the position x(t) of the oscillating arm 4 tends to decrease until it reaches the relative minimum point $X_{p2}$.

Using methods identical to those described above, the lower electromagnet 8 is de-excited at the time instant $t_3$, at which the current $i_2(t)$ reaches its relative minimum point $I_{p2}$ and at which the oscillating arm 4 reaches its relative minimum point $X_{p2}$. At the time instant $t_3$, the control unit 11 estimates, according to the methods described above, the mechanical energy $E_M(t)$ dynamically stored in the mechanical system SM and calculates the excitation parameters (i.e. it calculates the value of the intensity, the value of the duration and the instant of commencement of the excitation current $i_1(t)$) of the upper electromagnet 8 as a function of the difference between the elastic energy $E_{EX1}$ statically stored by the spring 9 in the desired abutment position and the mechanical energy $E_M(t)$ dynamically stored in the mechanical system SM at the time instant $t_3$.

In the embodiment shown in FIG. 3, the control unit excites the upper electromagnet 8 with a current $i_1(t)$ from the time instant 4, which is relatively delayed with respect to the time instant $t_3$; as a result of the force of magnetic attraction generated by the upper electromagnet 8 and as a result of the elastic energy previously stored in the spring 9, the oscillating arm 4 is displaced towards the upper electromagnet 8 until it comes into abutment against the upper electromagnet 8 with a substantially zero speed of impact.

According to an alternative embodiment, the mechanical energy $E_M(t)$ dynamically stored in the mechanical system SM is calculated as the difference between the energy supplied magnetically by the electromagnets 8 to the mechanical system SM and the energy dissipated in the mechanical system SM; however, various experimental tests have shown that this estimation method is less precise and more complex to implement than the estimation of the mechanical energy $E_M(t)$ by means of the application of equation [12].

Experimental tests have shown that the control method described above for the control of the valve 2 from the above-mentioned rest condition make it possible bring the oscillating arm 4 from the rest position to the position of abutment against the upper electromagnet 8 in a rapid manner and, at the same time, with a substantially zero speed of impact, despite the fact that for significant intervals of time (in the embodiment shown in FIG. 3 between the time instant $t_3$ and the time instant $t_4$) both electromagnets 8 are de-excited and it is not therefore possible in any way to estimate the position x(t) of the oscillating arm 4, and that during all the many transients the position x(t) of the oscillating arm 4 cannot be detected with the necessary precision as a result of the continuous variation of the value of the flux $\phi(t)$.

Obviously, when the upper electromagnet 8 is excited and in stable operation (i.e. at the end of an ignition transient) it is possible accurately to calculate, by applying equation [10], the position x(t) of the oscillating arm 4 and, therefore, to control, in feedback, the position x(t) and the speed v(t) of this oscillating arm 4 in order to attempt to have a speed v(t) of impact against the lower electromagnet 8 which is substantially zero; however, the possibilities of final correction by means of the feedback control are relatively modest and in order to be really efficient, they have to be combined with the previous control of the excitation of the electromagnets 8 as described above.

What is claimed is:

1. A method for controlling an electromagnetic actuator for actuating an engine valve from a rest position to an abutment position, the electromagnetic actuator including an actuator body actuating the valve and two electromagnets, the valve held in the rest position by the actuator body being held by at least one elastic body in an intermediate position between the two de-excited electromagnets, the valve held in the abutment position by the actuator body being in a position of abutment against a first one of the electromagnets, the method comprising:

alternately exciting the two electromagnets in order to generate a progressively amplified oscillating movement of the actuator body about the intermediate position;

estimating a mechanical energy dynamically stored in the mechanical system formed by the actuator body and the elastic body before exciting each electromagnet; and calculating excitation parameters for each electromagnet as a function of the difference between an elastic energy statically stored by the elastic body upon the valve being in the abutment position and the mechanical energy dynamically stored in the mechanical system.

2. The method of claim 1, wherein the step of alternately exciting the two electromagnets comprises de-exciting each electromagnet when the actuator body reaches a limit position in which the speed of the actuator body is substantially zero.

3. The method of claim 2, further comprising the step of determining said limit position by detecting a minimum relative value of an electric current for exciting each electromagnet, the electric current being variable over time in order for each electromagnet normally to work with a constant magnetic flux value.

4. The method of claim 1, wherein the step of calculating excitation parameters comprises calculating said excitation parameters in a manner so as to minimize the time required to provide the actuator body with the difference between the elastic energy statically stored by the elastic body in the abutment position and the mechanical energy stored in the mechanical system.

5. The method of claim 4, wherein the step of calculating excitation parameters comprises calculating the excitation parameters as a function of the dissipation phenomena present in the mechanical system.

6. The method of claim 1, and including: prior to exciting each electromagnet, estimating the mechanical energy transferred magnetically from the electromagnets to the actuator body and estimating the mechanical energy dissipated by the actuator body, and calculating the mechanical energy dynamically stored in the mechanical system as the difference between the mechanical energy transferred magnetically from electromagnets and the mechanical energy dissipated.

7. The method of claim 1, wherein the step of estimating the mechanical energy comprises calculating the elastic energy stored by the elastic body upon the actuator body reaching a limit position in which the speed of the actuator body is substantially zero.

8. The method of claim 7, further comprising the step of determining the limit position by detecting a minimum relative value of an electric current for exciting each electromagnet, the electric current being variable over time in order for each electromagnet normally to operate with a constant magnetic flux value.

9. The method of claim 8, wherein the step of estimating the mechanical energy comprises calculating the elastic energy as a function of the characteristics of the elastic body and as a function of the position of the actuator body with respect to the electromagnet, said position being determined on the basis of the overall reluctance of a magnetic circuit comprising the electromagnet and the actuator body, the overall reluctance being calculated as the relationship between an overall value of ampere-turn associated with the magnetic circuit and a magnetic flux value passing through the magnetic circuit, the overall value of ampere-turns being calculated as a function of the electric excitation current of the electromagnet.

10. The method of claim 1, wherein the step of calculating excitation parameters comprises the parameters of intensity, duration, and instant of commencement of the excitation current supplied to the electromagnet.

* * * * *

UNITED STATES PATENT AND TRADEMARK OFFICE

CERTIFICATE OF CORRECTION

PATENT NO. : 6,659,422 B2
DATED : December 9, 2003
INVENTOR(S) : Gianni Padroni

It is certified that error appears in the above-identified patent and that said Letters Patent is hereby corrected as shown below:

Title page,
Item [73], Assignee, delete "Magnetti Marelli Powerstrain S.p.A" and substitute therefore -- Magneti Marelli Powertrain S.p.A --

Signed and Sealed this

Twenty-seventh Day of April, 2004

JON W. DUDAS
*Acting Director of the United States Patent and Trademark Office*